United States Patent [19]

Sisk

[11] 3,932,062

[45] Jan. 13, 1976

[54] BLOWER BLADE FOR ELECTRIC MOTORS

[75] Inventor: Hollis D. Sisk, Chesterfield, Mo.

[73] Assignee: Wagner Electric Corporation, Parsippany, N.J.

[22] Filed: Jan. 3, 1975

[21] Appl. No.: 538,304

[52] U.S. Cl. ..... 416/230; 416/241 A
[51] Int. Cl.[2] ..... F04D 29/28
[58] Field of Search ..... 416/24 A, 230, 240, 229

[56] References Cited

UNITED STATES PATENTS

| | | | |
|---|---|---|---|
| 3,033,293 | 5/1962 | Bihlmire | 416/240 |
| 3,245,476 | 4/1966 | Rodwick | 416/24 A |
| 3,306,588 | 2/1967 | Reid | 416/241 A X |
| 3,408,944 | 11/1968 | Belonger et al. | 416/241 A |
| 3,706,511 | 12/1972 | Abbott | 416/229 |

FOREIGN PATENTS OR APPLICATIONS

| | | | |
|---|---|---|---|
| 1,428,152 | 1/1969 | Germany | 416/241 A |

*Primary Examiner*—Everette A. Powell, Jr.
*Attorney, Agent, or Firm*—Eyre, Mann & Lucas

[57] ABSTRACT

An improved blower blade for electric motors is disclosed. The blower blade comprises from about 50 to about 75% polypropylene, from about 5 to about 10% glass fibers and from about 15 to about 45% inert filler.

4 Claims, 2 Drawing Figures

BLOWER BLADE FOR ELECTRIC MOTORS

The present invention relates to blower blades for electric motors.

Blower blades for electric motors are very well known in the art. They are affixed to the central shaft of the motor and serve to keep the motor cool during operation. One of the primary problems with blower blades is securing them in a fixed position on the shaft so that they rotate when the shaft rotates and do not slip with respect to the shaft. There are many known ways of doing this including set screws, keys and the like but such mechanical devices add considerably to manufacturing expense. There have also been fan blades which are press fitted onto shafts but it sometimes occurs over the life of the motor that there is not sufficient frictional force to maintain the blower blade from slipping with respect to the shaft.

One composition for press fitted fan blades which was formerly employed comprises about 60% polypropylene and about 40% by weight asbestos fibers. However, because of the known difficulties incurred with asbestos fibers, especially with respect to OSHA requirements, the use of asbestos has been largely discontinued. In its place has been employed glass fibers but glass fibers suffer from the fact that they are quite expensive as compared to asbestos and thus increase the cost of the blower blade, a most undesirable result.

In accordance with the present invention, it has been found that a blower blade can be made with excellent frictional properties from a composition comprising from about 50 to about 75% polypropylene, from about 5 to about 10% glass fibers and from about 15 to 45% inert filler. Quite surprisingly, the blower blades with the composition according to the present invention have even higher frictional values than had blower blades using considerably more glass fibers. Thus, a great economical saving is made at the same time that an improvement in frictional properties is obtained.

Figure 1:
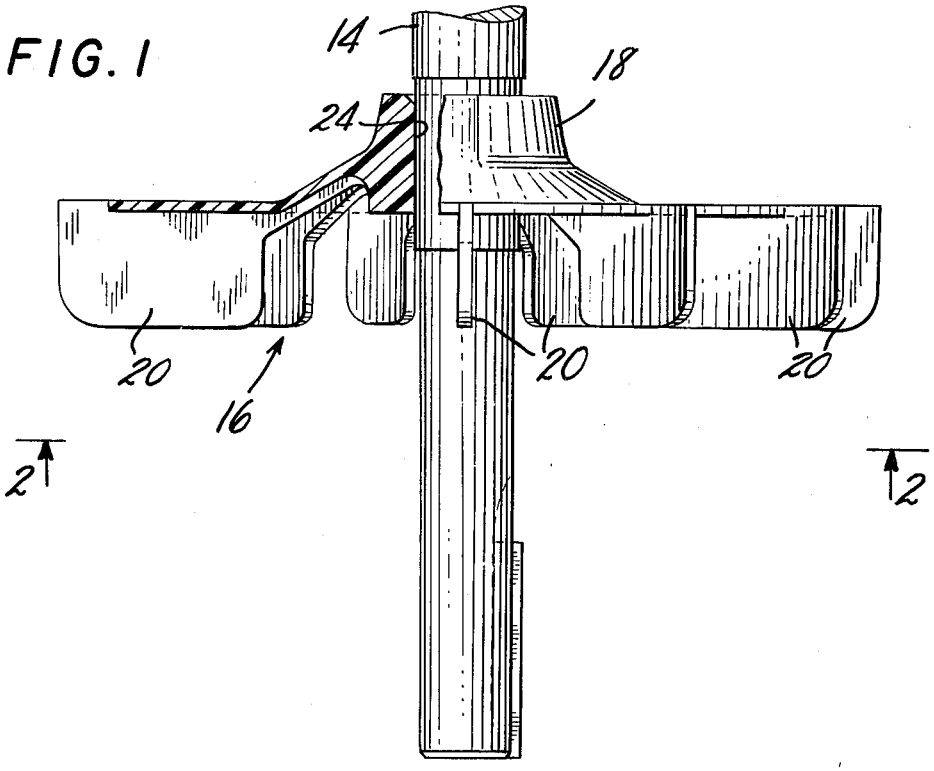
Figure 2:
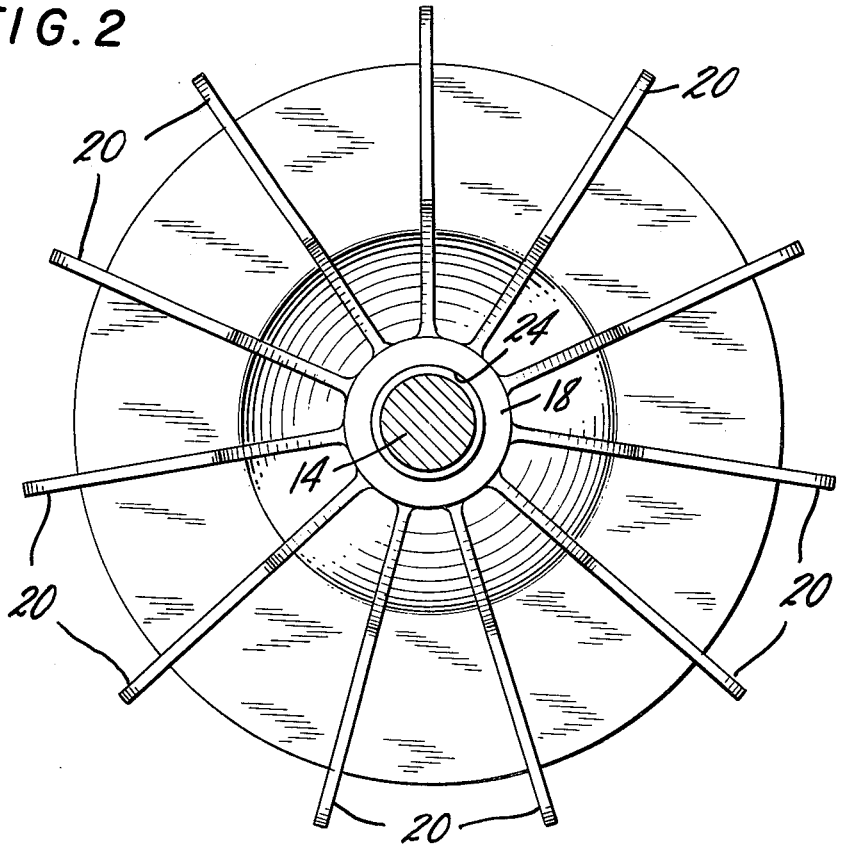

These and other features of the present invention can be more fully understood with reference to the drawings in which:

FIG. 1 shows a side view of a finished blower blade according to the present invention, and FIG. 2 shows a front view of FIG. 1.

Referring to FIG. 1, there is shown shaft 14 of a motor (not shown) having blower blade 16 press fit onto the end thereof. The blower blade 16 comprises a hub 18 and blades 20. As can be better seen in FIG. 2, the shaft 14 is round and the hub 18 is press fit onto it and held in place by frictional force and without any mechanical aid. The shaft 14 is generally a smooth cylindrical steel member and thus the frictional forces at the interface 24 between the shaft 14 and the hub 18 are very important since it is necessary to the proper functioning of the motor that the fan 16 not slip with respect to the rotation of the shaft 14.

As previously mentioned, the blower blades of the present invention are made from a composition comprising from about 50 to about 75% polypropylene, from about 5 to about 10% glass fibers, and from about 15 to about 45% inert filler. The size of the glass fibers of the present invention is not critical and they can suitably have a diameter of from about 0.3 mils to about 0.55 mils and a length of from about ⅜ inches to about ½ inches. Similarly, the inert filler employed in the present invention is not critical and any inert filler can be used. The principal feature of the inert fillers of the present invention is a reduction in cost of the total blower blade and it is therefore desirable to use an inert filler which is inexpensive. Typical of these are talc, clay, diatomaceous earth, sand, silica and the like.

A number of comparative tests have been made to measure the torque in inch-pounds necessary to make the blower blade 16 slip with respect to the shaft 14. In each case the same size shaft was used and the same size hole was used in the hub 18 of the blower blade 16. The results of the data are set forth in the examples below:

EXAMPLE 1

In this example a blower blade is made of 60% by weight polypropylene and 40% by weight asbestos. The blower blade is found to slip with respect to the shaft when a torque of approximately 22 inch-pounds is applied.

EXAMPLE 2

In this case a blower blade is made with 60% by weight polypropylene and 40% by weight inert filler. The particular inert filler employed is clay. The blower blade is found to slip when a torque of approximately 12 inch-pounds is applied.

EXAMPLE 3

A blower blade is made from a composition of 70% by weight polypropylene and 30% by weight glass fibers. The glass fibers have a diameter range of 0.3 mils to 0.55 mils and a length range of ⅜ inches to ½ inches. The blower blade slips with respect to the shaft when a torque of approximately 37 inch-pounds is applied.

EXAMPLE 4

Example 2 is repeated except that 5% of the inert filler is replaced by 5% of the glass fibers of Example 3. In this case the blower blade does not slip until a torque of approximately 45 inch-pounds is applied thereto.

EXAMPLE 5

Example 2 is again repeated except that 10% of the inert filler is replaced by 10% of the glass fibers of Example 3. In this case the torque to slippage is found to be above 45 inch-pounds.

EXAMPLE 6

In this case a blower blade is made from a composition comprising 50% polypropylene, 45% inert filler and 5% of glass fibers. Results comparable to those in Example 4 are obtained.

EXAMPLE 7

A blower blade is made from a composition comprising 75% polypropylene, 5% glass fibers and 20% inert filler. Results comparable to those in Example 4 are obtained.

EXAMPLE 8

In this case Example 7 is repeated except that the amount of inert filler is reduced to 15% and the amount of glass fibers is increased to 10%. The torque necessary to make the blower blade slip with respect to the shaft is comparable to that of Example 5.

EXAMPLE 9

Examples 2 and 4 are repeated using talc as the inert filler and comparable results are obtained.

EXAMPLE 10

Examples 2 and 4 are repeated using diatomaceous earth as the inert filler and comparable results are obtained.

EXAMPLE 11

A blower blade is made from a composition of 50% polypropylene, 5% glass fibers and 45% of the inert filler of Example 2. The drag necessary to make the blower blade slip with respect to the shaft is comparable to that of Example 4.

It will be understood that the claims are intended to cover all changes and modifications of the preferred embodiments of the invention herein chosen for the purpose of illustration which do not constitute departure from the spirit and scope of the invention.

What is claimed is:

1. A blower blade for electric motors comprising from about 50 to about 75% by weight polypropylene, from about 5 to about 10% by weight glass fibers, and from about 15 to about 45% inert filler.

2. The blower blade of claim 1 wherein the inert filler comprises at least one ingredient selected from the group consisting of talc, clay, diatomaceous earth, sand, and silica.

3. A blower blade for electric motors comprising about 60% by weight polypropylene, from about 5 to about 10% by weight glass fibers and from about 30 to about 35% by weight inert filler.

4. The blower blade of claim 3 wherein the inert filler is clay.

* * * * *